United States Patent [19]

Lorenzen et al.

[11] Patent Number: 4,926,886

[45] Date of Patent: May 22, 1990

[54] METHOD OF AND APPARATUS FOR MAKING A TRIMMED STREAM OF TOBACCO FIBERS OR THE LIKE

[75] Inventors: Heinz-Christen Lorenzen, Wentorf; Uwe Heitmann; Wolfgang Siems, both of Hamburg; Peter Pinck, Gross-Hansdorf, all of Fed. Rep. of Germany

[73] Assignee: Körber AG, Hamburg, Fed. Rep. of Germany

[21] Appl. No.: 225,694

[22] Filed: Jul. 28, 1988

[30] Foreign Application Priority Data

Jul. 31, 1987 [DE] Fed. Rep. of Germany ..... 3725365

[51] Int. Cl.[5] ..... A24C 5/18

[52] U.S. Cl. ..... 131/84.4; 131/905; 131/906

[58] Field of Search ..... 131/84.5, 84.4, 905, 131/906; 250/223 R, 229; 356/381, 384, 385

[56] References Cited

U.S. PATENT DOCUMENTS 4,423,742 1/1984 Reuland ..... 131/84.4
4,424,443 1/1984 Reuland ..... 131/905 X
4,595,027 6/1986 Higgins et al. ..... 131/84.4 X
4,785,830 11/1988 Moller et al. ..... 131/84.4 X

FOREIGN PATENT DOCUMENTS 0081391 6/1983 European Pat. Off. ..... 131/84.4
2179444 3/1987 United Kingdom .

*Primary Examiner*—V. Millin
*Assistant Examiner*—D. F. Crosby
*Attorney, Agent, or Firm*—Peter K. Kontler

[57] ABSTRACT

A stream of tobacco fibers is formed in a channel by showering the fibers against the underside of the lower reach of a foraminous belt conveyor which cooperates with a suction chamber to attract the fibers and to advance the stream past a trimming station where the surplus of fibers is removed by an adjustable equalizing device. The density of the stream is monitored upstream of the trimming station, and the thus obtained signals which are indicative of the density of successive increments of the stream are used to adjust the equalizing device so that the density of the trimmed stream is maintained within a desired range. Monitoring of density upstream of the trimming station ensures that the position of the equalizing device is properly adjusted not later than when the monitored increments of the stream reach the trimming station.

20 Claims, 2 Drawing Sheets

DENSITY MONITORING DEVICE
SUCTION GENERATING DEVICE
SIGNAL CORRECTING CIRCUIT
SIGNAL COMPARING STAGE
DENSITY MONITORING DEVICE
REVERSIBLE MOTOR
TRIMMER ADJUSTING UNIT
WRAPPING MECHANISM
SOURCE OF REFERENCE SIGNAL
D1
D2
D3
1
1a
1b
1c
2
2a
2a'
3
3a
4
6
6a
7
7a
8
9
11
12
13
14
18a
19a
22
22a
22b
23
24
26
27
28
29
31
31a
33
33a
33b
34

METHOD OF AND APPARATUS FOR MAKING A TRIMMED STREAM OF TOBACCO FIBERS OR THE LIKE

CROSS-REFERENCE TO RELATED CASES

The method and apparatus of the present invention are related to those which are disclosed in commonly owned copending patent application Ser. No. 225,693 filed Jul. 28, 1988 for "Apparatus for measuring the density of a tobacco stream" and in commonly owned copending patent application Ser. No. 225,692 filed Jul. 28, 1988 for "Method of and apparatus for treating accumulations of fibers of tobacco or other smokable material".

BACKGROUND OF THE INVENTION

The invention relates to improvements in methods of and in apparatus for making trimmed streams (called fillers) of tobacco or other fibrous material of the tobacco processing industry. More particularly, the invention relates to improvements in methods of and in apparatus for making trimmed streams of tobacco fibers or the like wherein the density of each increment of the trimmed stream matches or closely approximates a desired value.

A cigarette rod is normally obtained by admitting fragments of tobacco leaves into an elongated path wherein the fragments accumulate into a stream which is then advanced lengthwise past a trimming station where the surplus is removed so that the thus trimmed stream constitutes a filler which is ready for draping into a web of cigarette paper or other suitable wrapping material. As a rule, the density of the filler is monitored and the thus obtained signals are used to adjust the rate of admission of fragments of tobacco into the path if the ascertained density of the filler deviates from a desired optimum density. The monitoring operation can involve directing one or more beams of radiation against the advancing filler and ascertaining the intensity of that portion of radiation which has penetrated through the filler. The customary means for advancing the stream and the filler is an endless foraminous belt conveyor which cooperates with a suction chamber to attract the fragments of tobacco and to thus advance the stream and the filler along the respective portions of the path.

The means for monitoring the density of the filler normally employs a source of corpuscular radiation (such as beta rays) which is adjacent the path of the wrapped or unwrapped filler. Thus, each increment of the filler must cover a considerable distance before it reaches the monitoring station so that a relatively long portion of the filler is likely to be defective before the monitoring device detects the defect. Moreover, many makers of rod-shaped smokers' articles and filter rod sections are reluctant to utilize monitoring devices which embody sources of corpuscular radiation because the users of such radiation sources must satisfy stringent and expensive requirements concerning the safety of workmen in the plant which produces plain or filter cigarettes, filter rod sections or other rod-shaped articles of the tobacco processing industry.

OBJECTS OF THE INVENTION

An object of the invention is to provide a novel and improved method which need not invariably rely on sources of corpuscular radiation and renders it possible to reduce the number of rejects in a machine which turns out plain cigarettes, cigars or cigarillos or filter rod sections.

Another object of the invention is to provide a method which renders it possible to detect the presence of unsatisfactory portions of a stream of tobacco fibers, or a stream of other fibers which are processed in connection with the making of rod-shaped smoker's products (including filter rod sections), as soon as they develop.

A further object of the invention is to provide a novel and improved mode of regulating or adjusting the rate of removal of surplus from a stream of fibrous material of the tobacco processing industry.

An additional object of the invention is to provide a novel and improved apparatus for the practice of the above outlined method.

Another object of the invention is to provide a cigarette rod making or other rod making machine of the tobacco processing industry which embodies the improved apparatus.

Still another object of the invention is to provide the apparatus with novel and improved means for ensuring removal of optimum quantities of surplus from an unequalized stream of tobacco fibers or fibrous filter material for tobacco smoke.

A further object of the invention is to provide the apparatus with novel and improved means for monitoring the characteristics of the untrimmed stream of tobacco fibers or filter material.

An additional object of the invention is to provide the apparatus with novel and improved means for influencing the signals which are generated to denote the characteristics of the stream of tobacco fibers or fibrous filter material.

Another object of the invention is to provide the apparatus with novel and improved means for confining the monitoring of the stream of unequalized fibers to those portions which are to form the filler.

SUMMARY OF THE INVENTION

One feature of the present invention resides in the provision of a method of making and trimming a stream of fibers of smokable material or filter material for tobacco smoke. The method comprises the steps of establishing an elongated path, supplying fibers into a first portion of the path to form a continuous stream which contains a surplus of fibers, advancing the stream along the path in a predetermined direction, removing the surplus from the stream in a second portion of the path downstream of the first portion to thus convert the stream into a filler, monitoring the density of successive increments of the stream between the first and second portions of the path including directing against the stream at least one beam of radiation (whereby some of the radiation penetrates through the stream and is indicative of the density of corresponding increments of the stream) and generating density signals which denote the intensity of radiation that penetrates through the stream, and regulating or adjusting the surplus removing step in response to the density signals.

The monitoring step preferably includes monitoring the density of certain portions of successive increments of the advancing stream. The path is preferably at least substantially horizontal, and the monitoring step then includes monitoring the density of stream portions having a predetermined height. The height of the stream portions which are monitored preferably matches or approximates the height of the filler, especially the average height of the filler.

The method preferably further comprises the steps of monitoring the density of successive increments of the filler downstream of the second portion of the path including generating second signals which are indicative of monitored density of the filler, and utilizing the second signals to modify the corresponding density signals so as to compensate for the influence of differences between the predetermined height and the height of the filler.

Still further, the method can comprise the steps of monitoring the density of successive increments of the stream between the first and second portions of the path and generating additional signals which are indicative of monitored density of the stream, and utilizing the additional signals to modify the corresponding density signals so as to compensate for the influence of variations of the quantity of surplus in the stream upon the radiation which is directed against the stream.

The method can further comprise the step of continuously conforming the cross-sectional areas of the aforementioned stream portions to the cross-sectional areas of corresponding portions of the filler.

The radiation which is used for density measurement, at least for the generation of density signals, can constitute optical radiation, especially infrared light.

Another feature of the invention resides in the provision of an apparatus for making and trimming a stream of fibers of smokable material or filter material for tobacco smoke. The apparatus comprises guide means defining an elongated path, means for supplying fibers into a first portion of the path so that the fibers form a continuous stream which contains a surplus of fibers, means for advancing the stream along the path in a predetermined direction (such advancing means can constitute a component of the guide means), adjustable trimming means for removing the surplus in a second portion of the path downstream of the first portion to thus convert the stream into a filler, means for monitoring the density of successive increments of the stream between the first and second portions of the path including means for generating density signals which denote the monitored density, and means for adjusting or regulating the trimming means in response to the density signals.

In accordance with a presently preferred embodiment, the guide means comprises a channel for the fibers of the stream, and the channel has spaced-apart walls flanking the stream in the path and having registering openings between the first and second portions of the path. The monitoring means of such apparatus preferably includes at least one source of radiation which penetrates through one of the openings and thereupon into the stream between the openings whereby the radiation which penetrates through the stream and the other opening denotes the density of the increment of the stream between the two openings. The signal generating means is adjacent the other opening and is operative to generate density signals which are indicative of radiation that issues from the stream and passes through the other opening. The openings have predetermined cross sectional areas which are preferably indentical, and the walls of the channel are or can be substantially or exactly parallel to each other. The path is preferably horizontal or nearly horizontal so that the openings can be said to have predetermined heights. Such heights can equal or approximate the average height of the filler. Otherwise stated, the heights of the openings can equal or approximate the average distance between the advancing means and the trimming means.

The apparatus can comprise second monitoring means which is disposed downsteam of the trimming means and is operative to generate second signals which denote the density of successive increments of the filler, and means for modifying the density signals as a function of the corresponding second signals so as to compensate (if necessary) for the influence of differences between the predetermined heights of the openings in the walls of the channel and the height of the filler.

Still further, the apparatus can comprise additional monitoring means which is disposed between the first and second portions of the path and is operative to generate additional signals which denote the density of successive increments of the stream, and means for modifying the density signals as a function of the corresponding additional signals so as to compensate for the influence of variations of the quantity of fibers in the surplus upon the density signals.

The apparatus can further comprise means for varying the effective height of at least one of the openings. Such varying means can include shiftable diaphragm with an aperture and means for moving the diaphragm relative to the channel so as to vary the effective height of at least one of the openings in synchronism with adjustments of the trimming means.

The radiation source in the monitoring means which includes the means for generating density signals preferably includes means for emitting radiation in substantial parallelism with the advancing means and transversely of the elongated path. On the other hand, the monitoring means which generates the second and/or additional signals preferably includes means for directing against the filler or against the stream at least one beam of radiation along a substantially vertical path which is substantially or exactly normal to the advancing means. The advancing means can constitute an endless foraminous belt conveyor which cooperates with a suction chamber to attract the fibers and to advance the growing and fully grown stream along the elongated path toward the trimming means.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF PREFERRED EMBODIMENTS

Figure 1:
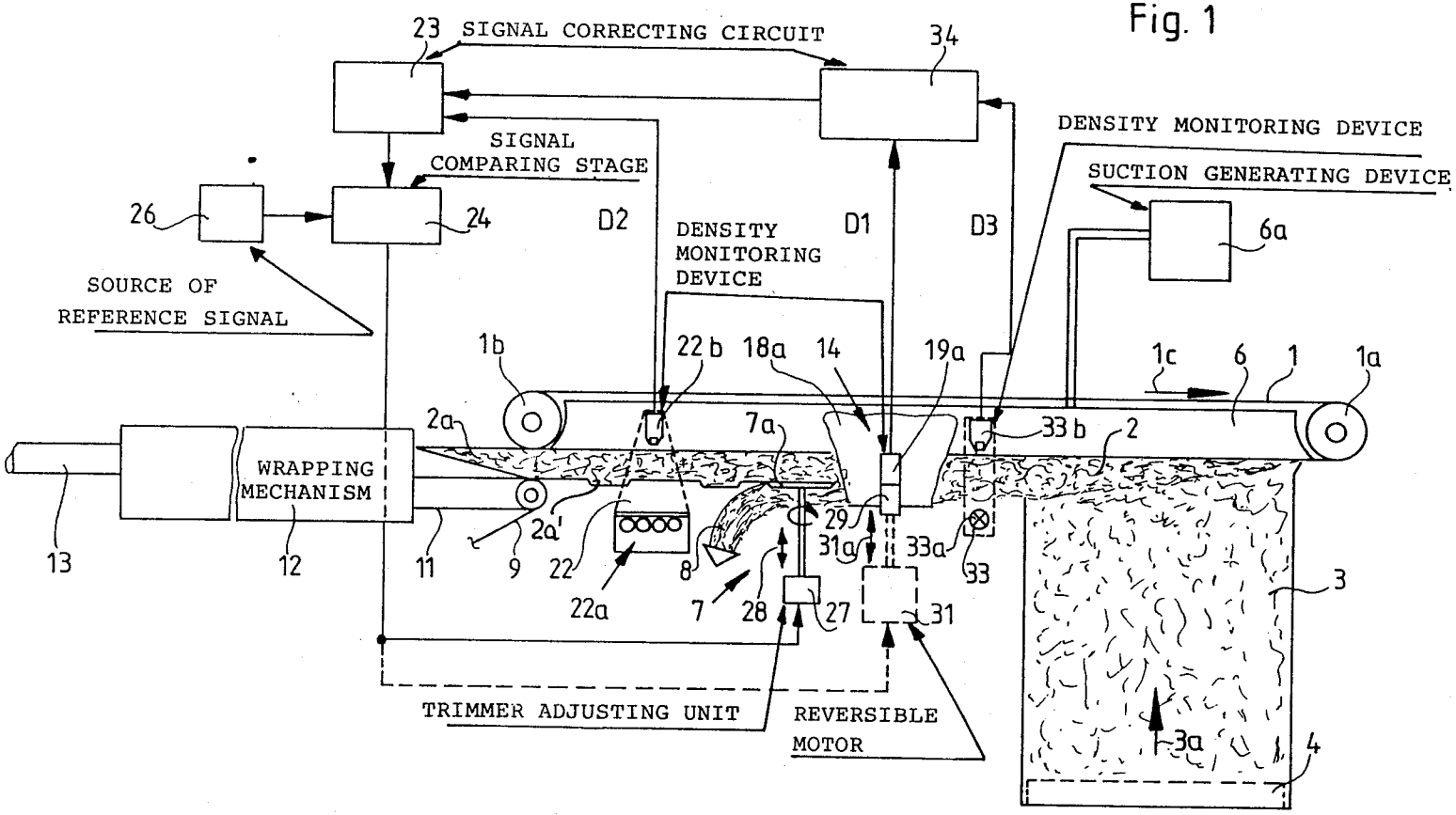
FIG. 1 is a fragmentary schematic elevational view of a cigarette rod making machine including an apparatus which embodies one form of the invention.

Referring first to FIG. 1, there is shown a portion of a cigarette rod making machine which turns out a continuous cigarette rod 13. Only those parts of the cigarette rod making machine are shown which can be said to constitute the elements of the improved apparatus and are necessary for full understanding of the invention. The apparatus comprises an endless foraminous belt conveyor 1 forms part of a guide means for tobacco fibers and which is trained over pulleys 1*a* and 1*b* (at least one of these pulleys is driven in a clockwise direction). The conveyor 1 advances in the direction which is indicated by an arrow 1*c*. The means for supplying fibers (such as fragments of tobacco leaves) to the underside of the lower reach of the conveyor 1 at the right-hand end of the elongated path which is defined by the conveyor in conjunction with the parallel vertical walls 18*a*, 18*b* (see FIG. 2) of a tobacco channel 16 includes an upright duct 3 wherein a rotary impeller 4 propels fibers in the direction of arrow 3*a*. Such fibers form a growing stream 2 which is fully grown not later than when moves beyond the duct 3 and advances with the lower reach of the conveyor 1 in a direction to the left, as seen in FIG. 1. The action of the impeller 4 can be assisted by a stream of compressed air or suction air which flows in the direction of arrow 3*a* to propel the fibers of tobacco toward the underside of the lower reach of the conveyor 1 at the stream building station which is located at the upper end of the duct 3. The fibers are attracted to the lower reach of the conveyor by suction which is generated by a suction chamber 6 having a foraminous bottom wall 17 (see FIG. 2) which is adjacent the upper side of the lower reach of the conveyor. The outlet of the suction chamber 6 is connected to the intake of a suitable suction generating device 6*a*, such as a fan.

The apparatus further comprises an adjustable trimming device 7 which is located downstream of the duct 3 (as seen in the direction of arrow 1*c*) and serves to remove the surplus 8 of fibers so that the stream 2 is converted into a continuous filler 2*a*. The trimming device 7 has two coplaner trimming discs 7*a* (only one is shown in FIG. 1) which remove the surplus 8 and can be provided with marginal notches so as to form the filler 2*a* with longitudinally spaced apart projections 2*a*′ if the cigarette rod 13 is to be subdivided into cigarettes with so-called dense ends. The construction of the trimming device 7 is conventional. The discs 7*a* cooperate with a rotary brush or paddle wheel (not shown) which sweeps away those fibers that extend beyond the plane of the discs 7*a*. The surplus 8 is returned to the distributor (also called hopper) which processes the surplus and returns the fibers into the duct 3 for readmission into the stream building zone at the underside of the lower reach of the conveyor 1.

The distance between the plane of the trimming discs 7*a* and the lower reach of the conveyor 1 determines the quantity of fibers which can bypass the trimming device 7 and form successive increments of the filler 2*a*. Such filler is advanced onto a continuous web 9 of cigarette paper or other suitable wrapping material which is transported by the upper reach of an endless belt conveyor 11 (known as garniture) serving to advance the filler 2*a* and the web 9 into and through a wrapping mechanism 12 of conventional design (reference may be had to the cigarette rod making machine which is known as PROTOS and is sold by the assignee of the present application). The mechanism converts the web 9 into a tube which surrounds the condensed filler 2*a* so that the filler and the web jointly form the cigarette rod 13. The latter is thereupon severed by a conventional cutoff (not shown to yield plain cigarettes of unit length or multiple unit length. The cigarettes can be delivered to a packing machine, to storage or to a filter tipping machine, not shown.

Figure 2:
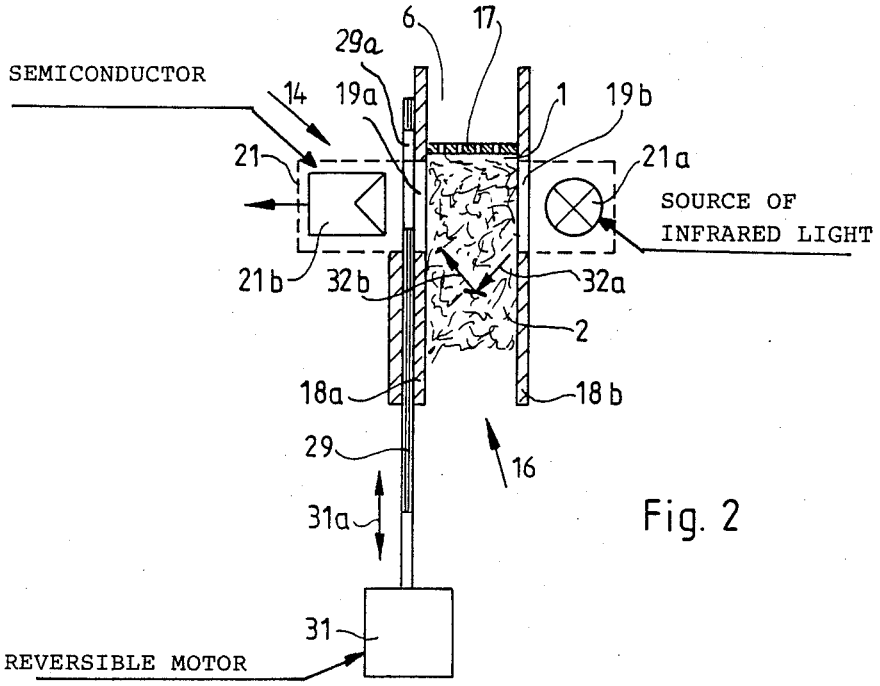
FIG. 2 is an enlarged transverse vertical sectional view of the apparatus at the station for the means which generates the density signals.

In accordance with a feature of the invention, the apparatus which is shown in FIGS. 1 and 2 further comprises a density monitoring device 14 which is located downstream of the duct 3 but upstream of the trimming device 7 and serves to ascertain the density of certain portions of successive increments of the untrimmed stream 2. The monitoring device 14 comprises an optoelectronic detector 21 including at least one radiation source 21*a* (FIG. 2) which is disposed at one side of the path of the stream 2, and a receiver 21*b* of radiation which is disposed at the other side of the path of the stream 2 and serves to generate density signals D1. As can be seen in FIG. 2, the wall 18*b* of the tobacco channel 16 has an opening or window 19*b* of predetermined height which is disposed immediately beneath the lower reach of the conveyor 1 and has the same size as a similar opening or window 19*a* in the wall 18*a*. Radiation (preferably infrared rays) which is emitted by the source 21*a* penetrates into the upper portion of the stream 2 beneath the conveyor 1, and that part of such radiation which penetrates through and beyond the stream 2 propagates itself through the window 19*a* prior to reaching the radiation-sensitive surface of the receiver 21*b*. The optoelectronic detector 21 including the source 21*a* and receiver 21*b* causes radiation to advance along a substantially horizontal path extending transversely of the elongated path for the stream 2 in the channel 16 and being substantially parallel to the lower reach of the conveyor 1.

The height of the openings 19*a*, 19*b* in the respective walls 18*a*, 18*b* of the tobacco channel 16 preferably equals or approximates the height of the equalized stream, i.e., of the filler 2*a*. That quantity of radiation which passes through the opening 19*a* and reaches the receiver 21*b* is indicative of the density of the corresponding portions of successive increments of the stream 2 in the tobacco channel 16.

When the cigarette rod making machine which embodies the improved apparatus is in actual use, the height of the equalized stream (filler 2*a*) will frequently depart from the height of the openings 19*a*, 19*b* in the walls 18*a*, 18*b* of the tobacco channel 16. The reason is that the trimming device 7 is adjustable, i.e., the discs 7*a* move up and down toward and away from the lower reach of the conveyor 1 in dependency upon the changes of intensity and/or other characteristics of density signals D1 which are generated by the receiver 21*b* of the optoelectronic detector 21 of the monitoring device 14. In order to compensate for the influence of such deviations of the height of the filler 2*a* from the height of the openings 19*a* and 19*b*, the improved apparatus comprises a second monitoring device 22 which is disposed downstream of the trimming device 7 (as seen in the direction of arrow 1*c*) in order to monitor the density of successive increments of the filler 2*a*. The illustrated second monitoring device 22 comprises a battery of radiation sources 22*a* (such sources can emit infrared light vertically upwardly) and a signal generating receiver 22*b*. The radiation sources 22*a* are located at a level below the path for the filler 2*a* and the receiver 22*b* can be installed in the suction chamber 6 above the lower reach of the conveyor 1. Second signals D2 which are transmitted by the receiver 22*b* of the second monitoring device 22 are indicative of density of successive increments of the filler 2*a*. Since the radiation sources 22*a* are located below and the receiver 22*b* is located above the path of the filler 2a, each signal D2 is indicative of the density of the entire cross section of the respective increment of the filler.

The first density signals D1 are transmitted to the corresponding input of a signal modifying or correcting circuit 34 and thence to a second signal modifying or correcting circuit 23. Another input of the circuit 23 receives second signals D2 from the receiver 22b of the monitoring device 22. The circuit 23 is designed to correct the density signals D1 as a function of the corresponding second signals D2 so as to eliminate the influence of the differences (if any) between the height of the openings 19a and 19b and the height of the increments of the filler 2a. In other words, the circuit 23 corrects the signals D1 in such a way that the corrected signals D1 properly reflect the density of successive increments of that portion of the stream 2 which bypasses the trimming device 7 and is converted into the filler 2a. The output of the circuit 23 transmits corrected density signals D1 to a signal comparing stage 24 which further receives a reference signal from a source 26. The reference signal which is transmitted by the source 26 is indicative of the desired or optimum density of successive increments of the filler 2a. If the corrected density signals D1 deviate from the reference signal which is transmitted by the source 26, the output of the signal comparing stage 24 transmits a signal to an adjusting or regulating unit 27 for the trimming device 7. The unit 27 can include a motor which serves to move the trimming discs 7a up or down (as indicated by a double-headed arrow 28) so as to compensate for deviations of the density of the stream portion above the lower edges of the openings 19a, 19b from the desired density.

Instead of or in addition to influencing of density signals D1 by the corresponding (second) signals D2 from the monitoring means, the apparatus can be provided with means for changing the effective height of at least one of the openings 19a, 19b as a function of the intensity and/or other characteristics of signals which are transmitted by the signal comparing stage 24. As shown in FIG. 2, the apparatus comprises a diaphragm 29 which is reciprocable up and down in directions indicated by a double-headed arrow 31a and has an aperture 29a which can be moved into more or less pronounced register with the opening 19a of the wall 18a to thereby influence the effective cross-sectional area, especially the height, of the opening 19a. The means for moving the diaphragm 29 up and down comprises a motor 31 which receives signals from the signal comparing stage 24. Since the signals from the comparing stage 24 are transmitted to the adjusting means 27 as well as to the motor 31, adjustments of the level of the diaphragm 29 take place in synchronism with adjustments of the level of the trimming discs 7a. In this manner, one ensures that the effective height of the opening 19a which admits radiation to the receiver 21b of the monitoring device 14 invariably matches the height of that portion of the stream 2 which is permitted to bypass the discs 7a and forms the filler 2a.

If desired, the adjusting unit 27 can also serve to move the diaphragm 29 up and down (i.e., the motor 31 can be omitted), or the motor 31 can serve to move the diaphragm 29 as well as the trimming discs 7a between different levels so that one can dispense with the adjusting means 27.

The arrows 32a, 32b indicate in FIG. 2 that radiation which issues from the source 21a does not propagate itself along an exactly horizontal path but is likely to be reflected and/or scattered by the fibers of the untrimmed stream 2 so that such radiation penetrates in part to a level beneath the lower edges of the openings 19a and 19b. The arrows 32a and 32b indicate but one of the possible composite paths for radiation which issues from the source 21a and ultimately reaches the receiver 21b so as to induce the latter to transmit somewhat misleading density signals D1 because such signals are also influenced by fibers which are located in the lower portion of the untrimmed stream 2, namely in the portion beneath the openings 19a and 19b. If the quantity of surplus 8 beneath the lower edges of the openings 19a, 19b fluctuates within a wide range, the amount of radiation which is scattered and/or reflected by such fluctuating surplus also fluctuates within a rather wide range. If the underside of the stream 2 is formed with deep valleys which alternate with pronounced hills, radiation which is scattered by the fibers in the region beneath the lower edges of the openings 19a, 19b is likely to penetrate through the underside of a shallow portion of the stream 2 and does not reach the receiver 21b. In other words, the amount of radiation which reaches the receiver 21b is dependent upon fluctuations of the quantity of surplus 8 which is carried by the stream 2 toward the trimming device 7.

In order to eliminate the undesirable influence of fluctuations of the surplus 8 in the stream 2 upon the accuracy of density signals D1, the improved apparatus preferably comprises an additional monitoring device 33 which is located upstream of the monitoring device 14 but downstream of the duct 3 and includes one or more radiation sources 33a beneath the underside of the stream 2 and one or more receivers 33b which are located in the suction chamber 6 above the lower reach of the conveyor 1 in line with the radiation source or sources 33a. Thus, radiation which issues from the source or sources 33a and propagates itself vertically upwardly penetrates through the entire stream 2 before it can reach the receiver or receivers 33b. The receiver or receivers 33b transmit additional density signals D3 which are used in the signal modifying or correcting circuit 34 to correct the density signals D1 before such signals are further corrected by the signals D2 in the modifying or correcting circuit 23. The radiation source or sources 33a can emit infrared light, and the receiver or receivers 33b can constitute one or more semiconductors which are sensitive to infrared light and transmit signals D3 each of which is indicative of the density of the corresponding increment of the advancing stream 2. This is in contrast to the operation of the monitoring device 14 which, as explained above, is mounted in such a way that it preferably ascertains the density of the upper portions of successive increments of the stream 2, namely on those portions which are to constitute the corresponding portions of the filler 2a. The manner in which the density signals D1 can be influenced or corrected by the corresponding signals D3 in the circuit 34 is well known in the relevant art and need not be described here. All that counts is to ensure that the corrected density signals D1 which are transmitted from the circuit 34 to the circuit 23 are truly indicative of the density of those portions of successive increments of the stream 2 which advance with the conveyor 1 above the lower edges of the windows 19a and 19b, and more particularly above the lower edge of the aperture 29a in the diaphragm 29.

It will be noted that the monitoring devices 22 and 33 cooperate to correct successive density signals D1 so as to ensure that such signals are not influenced by fluctuations of the surplus 8 and/or by fluctuations of the height and/or density of the filler 2a. In other words, the monitoring devices 22 and 33 enhance the accuracy with which the signals D1 can adjust the level of the trimming discs 7a and the level of the diaphragm 29 and its aperture 29a.

FIG. 1 shows the circuits 23, 24 and 34 as discrete components of the improved apparatus. In actual practice, a modern cigarette rod making machine will embody an integrated circuit which includes the components 23, 24 and 34 and is capable of carrying out the aforediscussed functions of such components.

An important advantage of the improved method and apparatus is that the density signals D1 are generated as a result of monitoring the density of successive increments of the stream 2 ahead of the trimming station. This ensures that the level of the trimming discs 7a is properly adjusted not later than when the corresponding increments of the stream 2 reach the trimming or surplus removing station. In other words, the density of each increment of the filler 2a is determined at the very instant when the surplus is removed from the corresponding portion of the stream 2.

Another important advantage of the improved method and apparatus is that the monitoring device 14 monitors only, or practically exclusively, the density of that portion of the stream 2 which is to form successive increments of the filler 2a. This is attributable to the provision of windows or openings 19a, 19b in the tobacco guide means including the channel 16 and conveyor 1, and to the provision of the vertically adjustable diaphragm 29 and its aperture 29a. As explained above, the effective height of the openings 19a, 19b is selected in such a way that it corresponds to the exact or average height of the filler 2a. This ensures an optimal conformance of the monitored stream portion to the corresponding portion of the filler. The purpose of the second monitoring device 22 is to compensate for frequently occurring deviations of the height of the filler 2a from the height of the monitored portions of the stream 2, namely of those portions of the stream 2 which are monitored by the device 14.

The purpose of the additional monitoring device 33 is to compensate for the aforedescribed fact that the height of the surplus 8 in the channel 16 ahead of the trimming station can influence the intensity of radiation which reaches the receiver 21b of the monitoring device 14. In the absence of the monitoring device 33, signals D1 would not invariably indicate the density of the upper portion of the stream 2 because such signals could be influenced in a manner as shown in FIG. 2 at 32a, 32b as well as because some of the radiation can escape beyond the underside of the stream 2 if the quantity of surplus 8 in certain portions of the stream 2 is minimal or zero. Since the radiation which issues from the source or sources 33a of the monitoring device 33 travels upwardly, it traverses the entire stream 2 before it reaches the receiver or receivers 33b so that the additional signals D3 are accurately indicative of the density of successive increments of the stream 2 ahead of the trimming station. This enables the modifying or correcting circuit 34 to properly correct successive density signals D1 before the corrected signals D1 are transmitted to the circuit 23 for correction as a function of the corresponding signals D2.

An additional important advantage of the improved apparatus is its simplicity as well as its compactness. This is important in many rod making machines wherein space is at a premium.

Still another important advantage of the improved apparatus is that it can operate without sources of corpuscular radiation, such as beta rays or X-rays. This is desirable in many plants because the utilization of corpuscular radiation renders it necessary to undertake numerous precautionary measures which contribute to complexity and cost of the machine.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

We claim:

1. A method of making and trimming a stream of fibers of smokable material or filter material for tobacco smoke, comprising the steps of establishing and elongated substantially horizontal path; supplying fibers into a first portion of the path to form a continuous stream which contains a surplus of fibers; advancing the stream along the path in a predetermined direction; removing the surplus from the stream in a second portion of the path downstream of the first portion to thus convert the stream into a filler; monitoring the density of portions of predetermined height of successive increments of the stream between the first and second portions of the path, including directing against the stream at least one beam of radiation whereby some of the radiation penetrates through the stream and is indicative of the density of corresponding increments of the stream, and generating density signals denoting the intensity of radiation which penetrates through the stream; regulating said surplus removing step in response to said density signals; monitoring the density of successive increments of the filler downstream of the second portion of said path, including generating second signals which are indicative of monitored density of the filler; and utilizing said second signals to modify the corresponding density signals so as to compensate, when necessary, for the influence of differences between said predetermined height and the height of the filler.

2. The method of claim 1, wherein the height of said stream portions matches or approximates the height of the filler.

3. The method of claim 1, wherein the height of said stream portions equals or approximates the average height of the filler.

4. The method of claim 1, wherein said radiation is optical radiation.

5. The method of claim 4, wherein said radiation is infrared light.

6. Apparatus for making and trimming a stream of fibers of smokable material or filter material for tobacco smoke, comprising guide means defining an elongated substantially horizontal path, said guide means comprising a channel for the fibers of the stream and said channel having spaced-apart walls flanking the stream in said path; means for supplying fibers into a first portion of the path so that the fibers form a continuous stream which contains a surplus of fibers, said guide means further including means for advancing the stream along said path in a predetermined direction; adjustable trimming means for removing the surplus in a second portion of said path downstream of said first portion to thus convert the stream into a filler, said spaced-apart walls having registering openings between the first and second portions of said path and said openings having predetermined heights; means for monitoring the density of successive increments of the stream between the first and second portions of said path, including at least one source of radiation which penetrates through one of said openings and thereupon into the stream between said openings whereby the radiation which penetrates through the stream and the other of said openings denotes the density of the increment of the stream between said openings, and means for generating density signals denoting the monitored density, said signal generating means being adjacent said other opening and being operative to generate density signals which are indicative of radiation that issues from the stream and passes through said other opening; means for adjusting said trimming means in response to said density signals; second monitoring means disposed downstream of said trimming means and operative to generate second signals denoting the density of successive increments of the filler; and means for modifying said density signals as a function of the corresponding second signals so as to compensate, when necessary, for the influence of differences between said predetermined heights and the height of the filler.

7. The apparatus of claim 1, wherein said openings have predetermined cross-sectional areas and said walls are substantially or exactly parallel to each other.

8. The apparatus of claim 6, wherein said heights equal or approximate the average height of the filler.

9. The apparatus of claim 6, wherein said heights equal or approximate the average distance between said advancing means and said trimming means.

10. The apparatus of claim 6, wherein said advancing means includes an endless conveyor having a substantially flat portion adjacent said monitoring means, said monitoring means including a source of radiation and said source including means for emitting radiation in substantial parallelism with said substantially flat portion.

11. The apparatus of claim 10, wherein said source includes means for emitting radiation substantially transversely of said path.

12. The apparatus of claim 6, further comprising at least one additional monitoring means for ascertaining the density of the stream or the filler and including means for directing against the stream or the filler at least one beam of radiation along a substantially vertical path.

13. The apparatus of claim 12, wherein said vertical path is substantially normal to said advancing means.

14. A method of making and trimming a stream of fibers of smokable material or filter material for tobacco smoke, comprising the steps of establishing an elongated path; supplying fibers into a first portion of the path to form a continuous stream which contains a surplus of fibers; advancing the stream along the path in a predetermined direction; removing the surplus from the stream in a second portion of the path downstream of the first portion to thus convert the stream into a filler; monitoring the density of portions of successive increments of the stream between the first and second portions of the path, including directing against the stream at least one beam of radiation whereby some of the radiation penetrates through the stream and is indicative of the density of corresponding increments of the stream, and generating density signals denoting the intensity of radiation which penetrates through the stream; continuously conforming the cross-sectional areas of said portions of successive increments of the stream to the cross-sectional areas of corresponding portions of the filler; and regulating said surplus removing step in response to said density signals.

15. A method of making and trimming a stream of fibers of smokable material or filter material for tobacco smoke, comprising the steps of establishing an elongated path; supplying fibers into a first portion of the path to form a continuous stream which contains a surplus of fibers; advancing the stream along the path in a predetermined direction; removing the surplus from the stream in a second portion of the path downstream of the first portion to thus convert the stream into a filler; monitoring the density of successive increments of the stream between the first and second portions of the path, including directing against the stream at least one beam of radiation whereby some of the radiation penetrates through the stream and is indicative of the density of the corresponding increments of the stream, and generating density signals denoting the intensity of radiation which penetrates through the stream; monitoring the density of successive increments of the stream between the first and second portions of the path and generating additional signals which are indicative of monitored density; utilizing said additional signals to modify the corresponding density signals so as to compensate for the influence of variations of the quantity of surplus in the stream upon the radiation which is directed against the stream; and regulating said surplus removing step in response to said modified density signals.

16. Apparatus for making and trimming a stream of fibers of smokable material or filter material for tobacco smoke, comprising guide means defining an elongated path; means for supplying fibers into a first portion of the path so that the fibers form a continuous stream which contains a surplus of fibers, said guide means including means for advancing the stream along said path in a predetermined direction; adjustable trimming means for removing the surplus in a second portion of said path downstream of said first portion to thus convert the stream into a filler; means for monitoring the density of successive increments of the stream between the first and second portions of said path, including means for generating density signals denoting the monitored density; additional monitoring means disposed between the first and second portions of said path and operative to generate additional signals denoting the density of successive increments of the stream; means for modifying said density signals as a function of corresponding additional signals so as to compensate for the influence of variations of the quantity of fibers in the surplus upon said density signals; and means for adjusting said trimming means in response to said modified density signals.

17. Apparatus for making and trimming a stream of fibers of smokable material or filter material for tobacco smoke, comprising guide means defining an elongated substantially horizontal path, said guide means comprising a channel for the fibers of the stream and said channel having spaced-apart walls flanking the stream in said path; means for supplying fibers into a first portion of the path so that the fibers form a continuous stream which contains a surplus of fibers, said guide means further including means for advancing the stream along said path in a predetermined direction; adjustable trimming means for removing the surplus in a second portion of said path downstream of said first portion to thus convert the stream into a filler, said spaced-apart walls having registering openings between the first and second portions of said path and said openings having predetermined heights; means for varying the effective height of at least one of said openings; means for monitoring the density of successive increments of the stream between the first and second portions of said path, including at least one source of radiation which penetrates through one of said openings and thereupon into the stream between said openings whereby the radiation which penetrates through the stream and the other of said openings denotes the density of the increment of the stream between said openings, and means for generating density signals denoting the monitored density, said signal generating means being adjacent said other opening and being operative to generate density signals which are indicative of radiation that issues from the stream and passes through said other opening; and means for adjusting said trimming means in response to said density signals.

18. The apparatus of claim 17, wherein said radiation is optical radiation.

19. The apparatus of claim 17, wherein said radiation is infrared light.

20. The apparatus of claim 17, wherein said means for varying the effective height of at least one of said openings includes means for varying such effective height in synchronism with adjustments of said trimming means.

* * * * *